US006132666A

United States Patent [19]

Foley et al.

[11] Patent Number: 6,132,666

[45] Date of Patent: Oct. 17, 2000

[54] METHOD FOR MAKING FORMED FABRIC TREATMENTS

[75] Inventors: William Howard Foley, Grandville; Thomas J. Newhouse, Grand Rapids, both of Mich.

[73] Assignee: Interface, Inc., Atlanta, Ga.

[21] Appl. No.: 08/885,745

[22] Filed: Jun. 30, 1997

[51] Int. Cl.[7] ..... B29C 43/10; B29C 43/12; B32B 31/20; F16S 1/06

[52] U.S. Cl. ..... 264/313; 52/144; 52/145; 52/481.2; 156/222; 156/583.3; 264/316; 428/81; 428/83

[58] Field of Search ..... 156/222, 224, 156/285, 583.3; 264/510–512, 546, 313, 316; 29/897.32, 453; 52/144, 145, 796.1, 773, 481.2; 428/83, 119–120, 122, 121, 81

[56] References Cited

U.S. PATENT DOCUMENTS

| | | | |
|---|---|---|---|
| 1,209,308 | 12/1916 | Lanhoffer | 264/316 X |
| 1,438,966 | 12/1922 | Perry . | |
| 2,363,323 | 11/1944 | Hill . | |
| 2,385,083 | 9/1945 | Kemerer | 264/316 X |
| 2,406,628 | 8/1946 | Patchen | 156/583.3 X |
| 2,418,438 | 4/1947 | Watts | 156/222 |
| 2,458,864 | 1/1949 | Lindsay | 156/224 |
| 2,524,932 | 10/1950 | Schulman | 264/316 X |
| 2,532,442 | 12/1950 | Daly | 156/224 X |
| 3,307,990 | 3/1967 | Homier et al. . | |
| 3,328,927 | 7/1967 | Kates . | |
| 3,408,239 | 10/1968 | Wedin . | |
| 3,428,506 | 2/1969 | Johnstone . | |
| 3,608,264 | 9/1971 | Jones et al. . | |
| 3,706,171 | 12/1972 | Shayman . | |
| 3,831,330 | 8/1974 | Tacke et al. . | |
| 3,993,828 | 11/1976 | McCorsley, III . | |
| 4,123,879 | 11/1978 | Blodee et al. . | |
| 4,135,341 | 1/1979 | Johnson et al. . | |
| 4,144,924 | 3/1979 | Vanden Hoek . | |
| 4,169,176 | 9/1979 | Hartmann et al. . | |
| 4,199,635 | 4/1980 | Parker . | |
| 4,214,646 | 7/1980 | Planes et al. . | |
| 4,219,598 | 8/1980 | Noma et al. . | |
| 4,251,104 | 2/1981 | Holt . | |
| 4,258,093 | 3/1981 | Benedyk . | |
| 4,277,531 | 7/1981 | Picone . | |
| 4,282,283 | 8/1981 | George et al. . | |
| 4,302,499 | 11/1981 | Grisch . | |
| 4,307,145 | 12/1981 | Goldman . | |
| 4,359,132 | 11/1982 | Parker et al. . | |
| 4,373,001 | 2/1983 | Smith et al. . | |
| 4,391,865 | 7/1983 | Constance . | |
| 4,424,250 | 1/1984 | Adams et al. . | |
| 4,428,454 | 1/1984 | Capaul et al. . | |

(List continued on next page.)

FOREIGN PATENT DOCUMENTS

| | | |
|---|---|---|
| 2018516 | 6/1991 | Canada . |
| 0 234 473 A2 | 9/1987 | European Pat. Off. . |
| 32 29 884 A1 | 2/1984 | Germany . |

OTHER PUBLICATIONS

International Search Report of PCT/US98/12756 (Aug. 28, 1998).

*Primary Examiner*—Adrienne C. Johnstone
*Attorney, Agent, or Firm*—Kilpatrick Stockton LLP; John S. Pratt; James J. Bindseil

[57] ABSTRACT

A molded fabric treatment includes an integral undercut or inturned peripheral flange for affixing the treatment to the structure to be treated. The treatments have a conventional, decorative, woven polyester fabric (of the type currently used in conventional office divider screen systems), or fabrics comprising other synthetic or natural fibers, bonded with adhesive to a relatively stiff moldable non-woven polyester fiber backing. The treatments are formed in a membrane or bladder press in which a flexible membrane presses the fabric and fiber composite against a form or mold that includes an undercut edge which, in cooperation with the press membrane, forms undercut flanges about the periphery of the treatment. The undercut or inturned flange may then be "snapped" over a corresponding mounting lip on the structure to be treated.

41 Claims, 11 Drawing Sheets

U.S. PATENT DOCUMENTS 4,432,822 2/1984 Adams et al. .
4,445,954 5/1984 Adams et al. .
4,474,840 10/1984 Adams .
4,491,617 1/1985 O'Connor et al. .
4,515,848 5/1985 Leunig et al. .
4,581,272 4/1986 Walters et al. .
4,581,453 4/1986 Ippen et al. .
4,635,410 1/1987 Chumbley .
4,726,987 2/1988 Trask et al. .
4,744,189 5/1988 Wilson .
4,838,380 6/1989 Lassiter .
5,086,606 2/1992 Finses .
5,111,579 5/1992 Andersen .
5,121,578 6/1992 Holz .
5,238,515 8/1993 Insalaco et al. .
5,265,333 11/1993 Lim et al. ..... 29/897.32
5,298,694 3/1994 Thompson et al. .

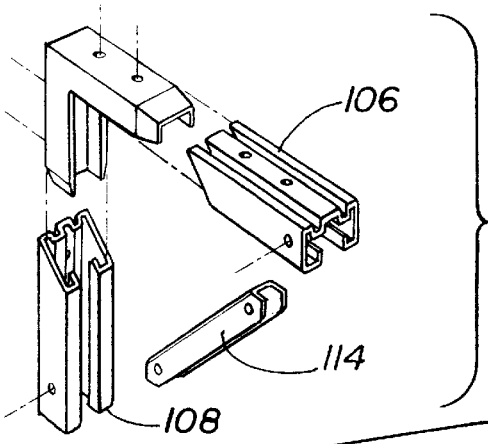
FIG 21
FIG 20
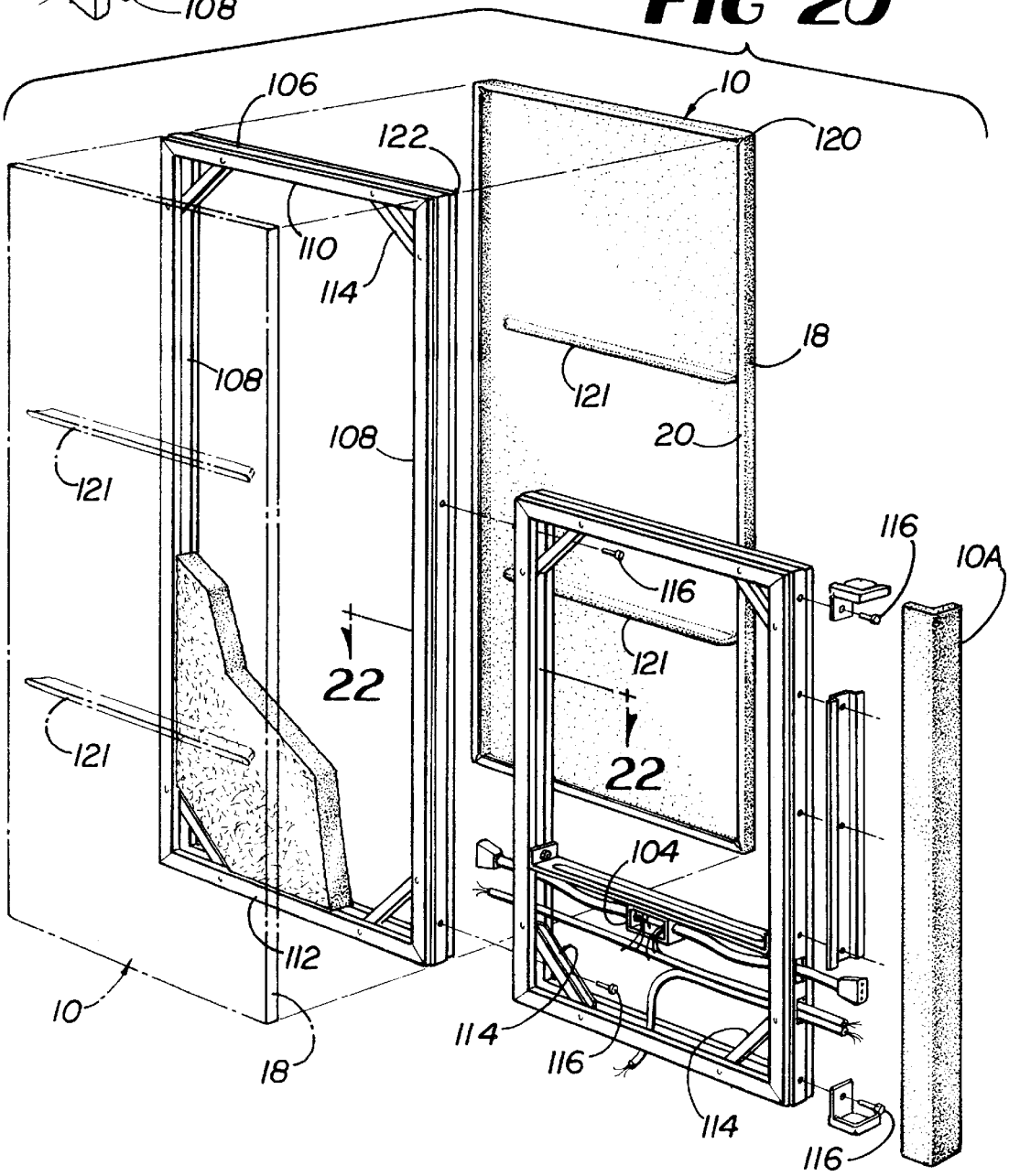

METHOD FOR MAKING FORMED FABRIC TREATMENTS

BACKGROUND OF THE INVENTION

Fabrics are often used to cover surfaces and structures for aesthetic and functional purposes. For example, fabric treatments may be used as speaker grilles to conceal and protect the speaker elements. Fabric treatments are often used for lampshades which help decorate a room and soften the glow of the illumination source. Fabrics also may be used for wall or window treatments (both as curtains and on window cornices) which provide decoration and may also conceal installations, such as speakers, audio/visual devices or heating and cooling ducts. Fabrics also may be used for the modular divider screens that are commonly used to divide office space into one or more cubicles, thereby providing personal space and privacy for employees as well as providing acoustic damping and fire protection. Conventional office dividers allow the layout and appearance of the office space easily to be altered, either by rearranging the dividers, or simply by replacing the panels with new panels having fabrics of a different color and/or texture.

In many of these applications, the fabric treatments are affixed to a structural frame which gives shape to the fabric. For instance, conventional office dividers typically use a rigid steel or aluminum frame to which panels are affixed by fasteners or moldings. The panels typically have a rigid backing sheet, often pressed fiberboard or metallic fabrications, to which one or more layers of fabric are affixed. Speaker grilles, lampshades and window cornices also use frames over which the fabric is stretched and affixed.

Manufacture and installation of conventional fabric treatments can be complex, time consuming and expensive. For example, the outer layer of fabric applied to the structure, i.e., the layer visible when the structure is in use, will often include a decorative or otherwise visible weave pattern which is directional in nature. Because several structures may be used in conjunction, such as with office dividers or window treatments, it is important for the directional patterns to be oriented precisely and consistently from structure to structure. If the structures are not carefully matched, any difference between the orientation of the pattern between two adjacent structures may be glaringly apparent and highly unattractive. Treatments typically are applied by stapling or otherwise affixing the fabric to the structure. As a result, it is difficult to precisely align the fabric on the structure in a consistent manner. This problem is complicated by the fact that any wrinkles in the fabric are also unsightly. Thus, it is important to stretch the fabric tightly about the structure as it is being affixed. The stretching process creates a greater likelihood that the fabric will not be properly aligned. Moreover, the fabric must be gathered at corners, thus forming pleats or other flaps of material that are visible at the corner. Also, because many of the structures are heavy and unwieldy, such as fiberboard backers of divider panels, installation and replacement of the treatments may be difficult.

U.S. Pat. No. 5,111,579 to Anderson teaches a method for making a cover panel for an office divider comprising a multi-layer composite sheet. At least one layer, the backing layer is a non-woven material which may be formed or molded into a desired shape. Another layer of the sheet is a decorative fabric layer which may be bonded to the backing layer prior to the molding process to form a composite sheet. The composite sheet is then molded to form a panel suitable for use with a divider frame. Fasteners are positioned along the sides of the panel. The top and bottom of the panel are molded to form step-like flanges. The fasteners are used to affix the sides of the panels to the frame. The step-like flanges are captured between the frame and top and bottom frame caps. This process creates a panel that is sufficiently rigid to be used without a pressed fiberboard backing and sufficiently light to allow easy manipulation and installation. Moreover, because the fabric is formed with the backing sheet, it is more easily and precisely aligned, thus reducing the likelihood of misaligned and unsightly installations.

The Anderson panels do not, however, overcome all of the drawbacks associated with the installation and maintenance of office dividers. For example, Anderson describes panels that are affixed to frames with a series of fasteners or clips attached along two of the margins of the panel. The other two edges are formed to define stepped flanges which are captured between the frame and a cap or molding affixed to the frame. Thus, the manufacture of the panel is complicated by the need to attach a series of fasteners. Additional workstations and machinery must be provided to install the fasteners, thus increasing the cost of each panel. Moreover, when the panel is installed, the process is complicated by the need to secure the caps or moldings to the frame. In large installations, even the seemingly trivial act of securing one or two moldings per panel can dramatically increase the overall time required to complete the installation. Also, Anderson's panel forming method produces folds or pleats at the corners of the panels that may be unsightly. Moreover, Anderson's method would be difficult to use with more intricate treatments, such as lampshades and window treatments.

Thus, it is desirable to provide an easy to manufacture, moldable fabric treatment for office dividers, speaker grilles, lampshades, window and wall treatments and other decorative and functional applications; that may be installed with little or no need for additional fasteners or the use of caps or moldings to secure the panel in place; and that can be molded with corners without the need for pleats or flaps.

SUMMARY OF THE INVENTION

The present invention provides a method and apparatus for forming fabric treatments having an integral affixing means comprising undercut flanges for securing the treatment to the structure to be treated. The fabric treatments are formed in a membrane or bladder press. A flexible membrane presses a fabric lay-up against a tool that includes an undercut edge. The undercut cooperates with the press membrane to form undercut flanges about the periphery of the treatment. Grooves, raised ribs or other decorative features may be placed on the tool to create, if desired, complimentary features on the formed treatment that may be decorative and may also stiffen the panel and resist tendencies for the fabric panel to assume non-planar shapes in use.

The fabric lay-up is made up of a layer of conventional, decorative, woven polyester fabric (of the type currently used in conventional fabric treatments), or fabrics comprising other synthetic or natural fibers, and a relatively stiff non-woven polyester fiber backing. The backing comprises non-woven fibers in a binder matrix. The non-woven fibers may include some proportion of an activating or heat-fusible fiber which works with the binder to allow the backing to be molded. The activating fiber is hardened by heat applied during the molding process, thus stiffening the formed lay-up and allowing it to hold a desired shape. Adjacent layers are not bonded prior to molding to allow slippage between the layers. This slippage allows the final product to attain its desired shape without wrinkling or pleating of the outer fabric at corners. The slippage also allows the proper formation of the undercut flanges and smooth corners. A heat- or pressure-activated adhesive layer is applied to the surface of one or both of the fabric layers so that layers are bonded together once the lay-up is conformed to the tool.

The molding process creates a relatively stiff fabric and backing composite having a flange about the periphery of a central region. The edge of the flange forms an undercut lip. The process also creates smooth corners with no flap or pleat required to gather excess fabric. The structure to which such a treatment will be affixed is provided with a mounting lip about the area to be covered. The treatment is attached by pushing the undercut flange of the treatment over the mounting lip so that it "snaps" into place. Also, the mounting lip may be formed with a spring-like structure that provides additional force to hold the treatment in place.

Fabric treatments of the invention have many desirable characteristics. For instance, modular office dividers using the treatments are lighter than conventional office wall divider systems and permit substantial on-site assembly of the systems. Divider frames are simply bolted together or otherwise assembled from components on site. The cover panels are then "snapped" into position on the frames. The system is economical and facilitates easy removal and replacement of damaged fabric panels. Furthermore, it is unnecessary to use Tee-molding or other clamping arrangements, which may be expensive and time consuming to install, to hold fabric edges in place. Likewise, wall and window treatments, speaker grilles and lampshades are lighter, less complex and easier to install and replace.

Accordingly, it is an object of the present invention to provide fabric treatments which may be easily molded into a variety of shapes.

An additional object of the present invention is to provide molded fabric treatments which have relatively smooth corners with no flaps or noticeable folds.

A further object of the present invention is to provide a means for affixing molded fabric treatments to the structure being treated without the need for fasteners.

Another object of the present invention is to provide molded fabric treatment which may be "snapped" onto the structure being treated.

Yet another object of the present invention is to provide modular office dividers which are easily assembled.

An additional object of the present invention to provide modular office divider screens which are lightweight.

A further object of the present invention to provide cover panels for modular office divider screens which are lightweight and which may be easily affixed to the divider frames.

Another object of the present invention to provide panels for modular office divider screens which are easily manufactured.

Yet another object of the present invention to provide panels modular office divider screens which have a facing fabric which may be precisely aligned.

An additional object of the present invention is to provide panels for modular office divider screens which may be manufactured with a minimum of selvage.

A further object of the present invention is to provide a molded fabric treatment which may be easily recycled.

Other objects, features and advantages of the present invention will become apparent with reference to the remainder of this document.

BRIEF DESCRIPTION OF THE DRAWINGS

FIG. 20 is an exploded perspective view of two sections of the assembly of FIG. 19.

FIG. 21 is a perspective view of a portion of the rail of the frame of FIG. 20.

DETAILED DESCRIPTION OF THE DRAWINGS

Figure 1:
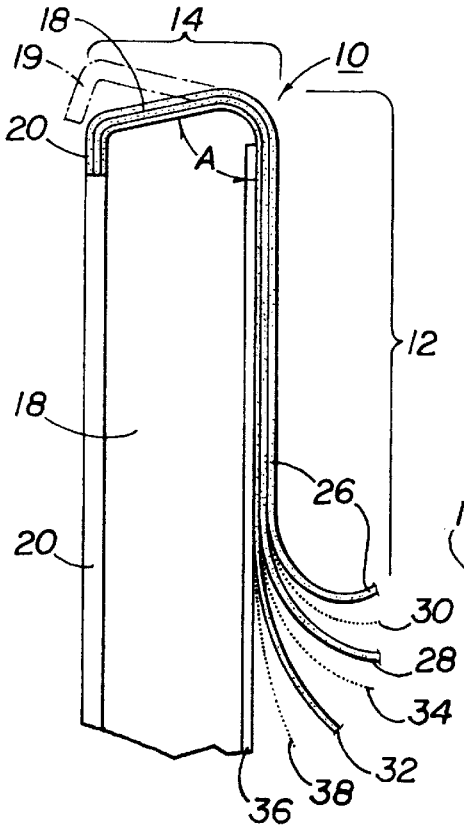
FIG. 1 is a partial cross-sectional view of the fabric treatment in accordance with the present invention.
Figure 2:
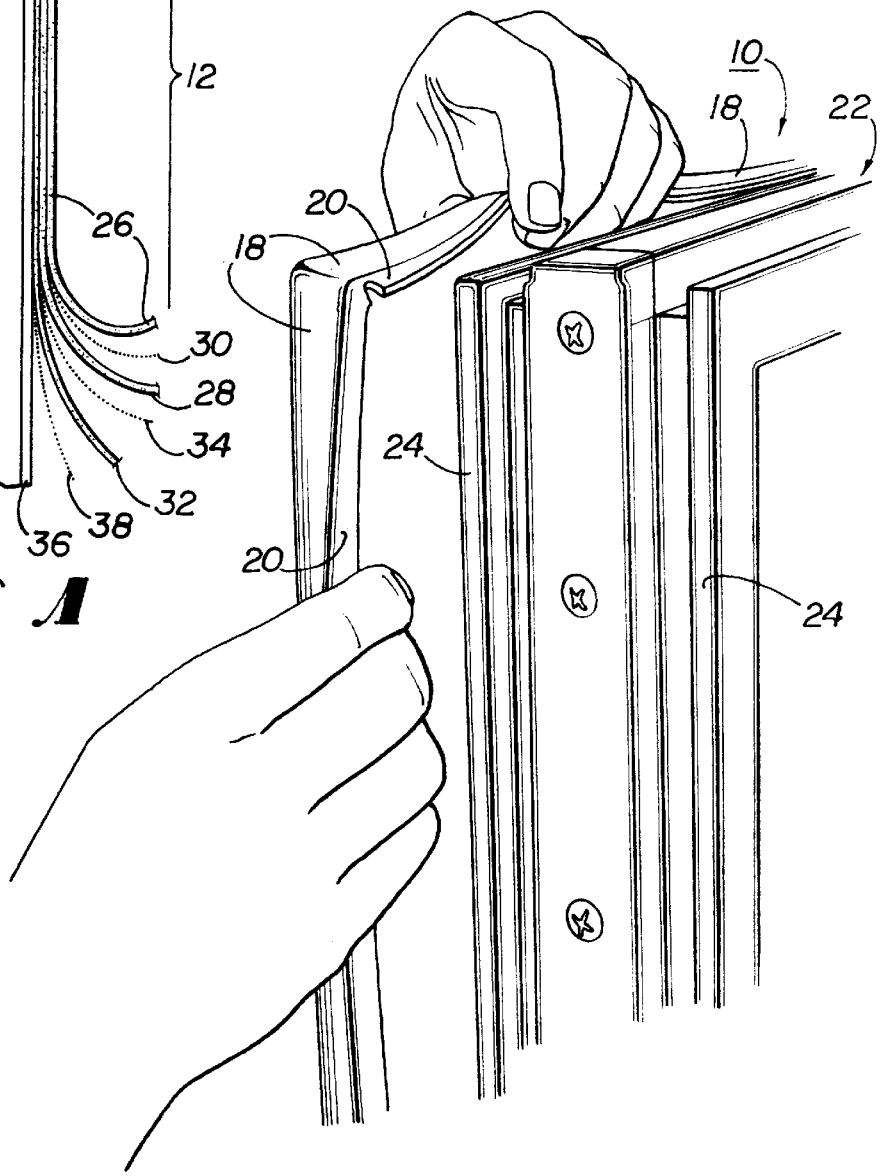
FIG. 2 is a perspective of the treatment of FIG. 1 being installed on a structure.

FIGS. 1 and 2 show formed fabric treatment 10 in accordance with the present invention. Treatment 10 includes a central portion 12 and an affixing portion 14. Central portion 12 may be planar or may be formed to any desired shape, within the constraints of the process described below. Affixing portion 14 includes a flange 18 which is formed at the periphery of central portion 12 and is folded inward at angle A. Flange 18 is flexible, allowing it to be pulled out slightly for installation as shown by the ghost lines 19. Angle A is typically about ninety degrees, but may be made larger or smaller depending on the anticipated use of treatment 10. An inwardly turned or "undercut" lip 20 turns inwardly from flange 18 and is typically parallel to central portion 12 (if central portion 12 is planar). Flange 18 and lip 20 cooperate with central portion 12 to affix treatment 10 to the structure to be treated.

As shown in FIG. 2, structure 22, which may be an office divider, speaker cabinet, lampshade, window or wall treatment, or any other structure to which it may be desirable to affix a fabric treatment, includes mounting lip 24 which is complimentary in shape and size to the combination of flange 18 and lip 20. Flange 18 and lip 20 are "snapped" over mounting lip 24, thereby affixing treatment 10 to structure 22.

Referring again to FIG. 1, treatment 10 is formed by at least three layers. Facing layer 26 is a conventional, decorative, woven polyester fabric, or another synthetic or natural fiber fabric.

Backing layer 28 is a non-woven polyester fabric. Other non-woven fabrics, such as those using olefin, polypropylene or other moldable fibers may be used. It has been found that non-hygroscopic fibers are preferred for most applications, because panels formed with such fibers are less likely to deform in the presence of moisture; however, hydroscopic fibers may be appropriate or even desirable for particular applications. In an illustrative embodiment, approximately 20% of the non-woven fabric is a polyester "activating," i.e., heat-fusible, fiber which may be molded into a desired shape by the application of heat and pressure. Other proportions and different materials, such as olefin, polypropylene or other materials, may be used for the activating fibers as desired to tailor the characteristics of the final product for the desired use. A heat-activated binder, such as a polyester, olefin, polypropylene or other resin, may be used to further aid in the molding of backing layer 28. Because backing layer 28 may be molded, using heat and/or pressure, such that it remains in a desired form, no additional materials are required to form peripheral flange 18 and lip 20.

An adhesive layer 30 is positioned between layers 26 and 28. Adhesive layer 30 is a heat- or pressure-activated adhesive in web, powder or other conventional form. The adhesive may be a polyester, olefin, polypropylene or other suitable resin. Adhesive layer 30 may be pre-applied to layer 26 or 28 or both prior to molding. As described in detail below, layers 26 and 28 must be able to move with respect to each other at the beginning of the molding process. Thus, if a pressure-activated adhesive is used, it must allow layers 26 and 28 to move as desired before activating.

Other layers of material may be interposed between layers 36 and 38 or affixed to the inside of treatment 10 in order to provide other characteristics which may be desired, such as sound attenuation or flame retardance. For example, a fire retardant or sound attenuating sheet 32 may be bonded to layer 28 by adhesive layer 34. Sheet 32 may be bonded to treatment 10 after it has been formed or may be added to the lay-up (as described below) prior to molding. Similarly, backing board 36 may be attached with adhesive layer 38, prior to or after the molding process. Backing board 36 may be a chipboard sheet for stiffening treatment 10, and may, through the use of sound holes, be used to further attenuate sound or otherwise control the sonic characteristics of treatment 10. Adhesive layers 34 and 38 may be conventional adhesives. Heat- or pressure-sensitive adhesives may be used if layers 32 and/or 36 are to be applied during molding, otherwise any adhesive, such as polyester-based or other adhesives as appropriate, may be used. Layer 32 may also be interposed between layers 26 and 28, if desired.

It may be desirable to select the materials for the layers of treatment 10 such that they are of substantially like make-up. For instance, all layers, including the adhesive layers, may be made of polyester-based material. Selection of like materials will allow any selvage, i.e., scrap from the manufacturing process, as well as discarded treatments to be easily recycled. This is because the use of like materials obviates the need for separation of bonded layers—often a difficult task.

In the illustrative embodiment, backing layer 28 extends over the entirety of treatment 10. This is desirable if treatment 10 is to have decorative or structural features in central portion 12, or if it is desired that all of treatment 10 be stiff and/or relatively rigid. In some applications, such as speaker grilles, such structural or decorative aspects may not be desired. In such cases, backing layer 28 need only be present about the periphery of treatment 10 to allow the formation of flange 18 and lip 20, and protruding into central portion 12 only enough to allow affixing portion 14 to work properly.

Figure 6:
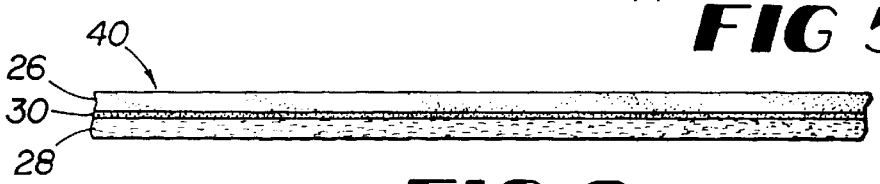
FIG. 6 is a cross-sectional view of the lay-up of the present invention.

As shown in FIG. 6, lay-up 40 includes facing layer 26 and backing layer 28. Adhesive layer 30 is interposed between layers 26 and 28. Other layers may also be provided as described above, although those other layers may also be applied to treatment 10 after the molding process. Adhesive layer 30 may be pre-applied to one or both of layers 26 and 28, but layer 30 does not bond layers 26 and 28 until the molding process has begun. The layers of lay-up 40 must be free to slide with respect to each other as bladder 46 is inflated so that the layers may be positioned to create the desired structure.

Figure 3:
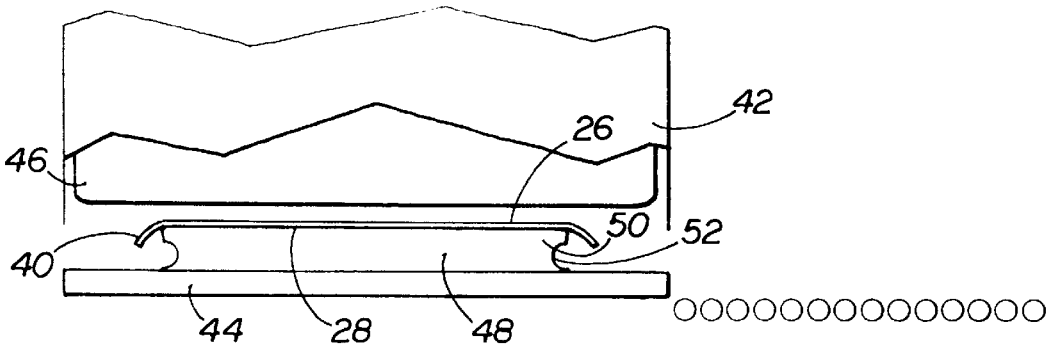
FIG. 3 is a cross-sectional view of a bladder press for forming the treatment of FIG. 1.
Figure 4:
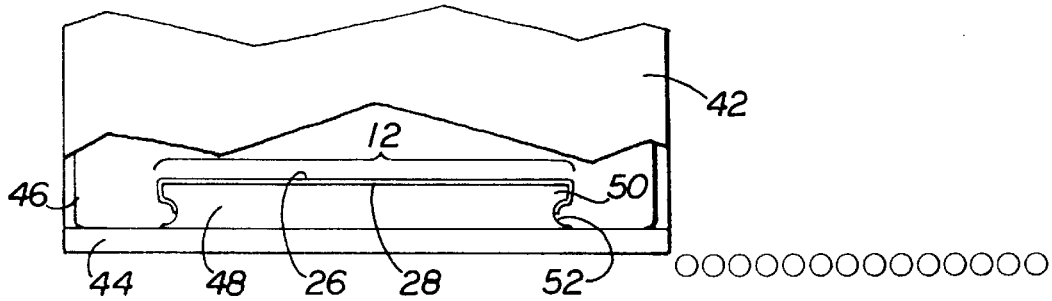
FIG. 4 is a cross-sectional view of the bladder press of FIG. 3 with the bladder inflated.
Figure 5:
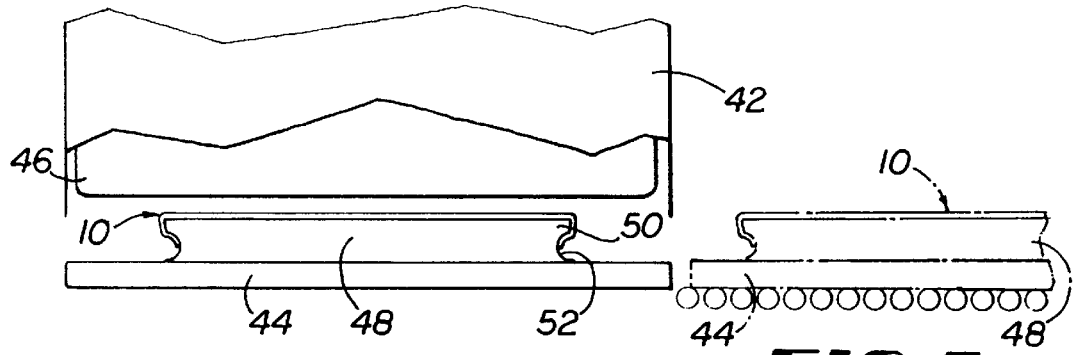
FIG. 5 is a cross-sectional view of the bladder press of FIG. 3 with the bladder deflated.

FIGS. 3–5 show the molding process for forming fabric treatments. A conventional bladder mold 42 of the type typically used to bond vinyl coverings on to cabinet doors, tabletops and moldings is provided. Lay-up 40 is placed in bladder mold 42.

Bladder mold 42 has a bed 44 and a bladder 46. Tool 48 is placed on bed 44. Tool 48 may be of any shape to produced the desired product. Tool 48 has lip 50 and undercut 52 provided substantially continuously about the perimeter of a central portion 12.

Bladder 46 is inflated, applying pressure which conforms lay-up 40 to tool 48 such that lay-up 40 is bent around lip 50 and forced into undercut 52. Heat may be applied by using hot air to fill bladder 46, thus heating lay-up 40. Other heat sources, such as heat lamps, coils or other conventional means may be used to heat lay-up 40 during molding. Tool 48 is preferably pre-heated as well in order to speed the molding process. The heat activates any adhesive layers in lay-up 40, which bonds the layers of lay-up 40. The heat also activates binders and activating fibers in backing layer 28 to further form treatment 10 in the desired shape.

Once sufficient heat and pressure have been applied to lay-up 40 long enough to assure that it has attained the desired shape and that all layers have been bonded together, bladder 46 is deflated and bed 44 is moved out of mold 42 and allowed to cool. Typically the process applies about 5.5 bars of pressure at 180 degrees Celsius for one hundred and twenty to one hundred and sixty seconds. Of course, these parameters may be varied depending on the materials selected and the desired results. Excess material, or "selvage" may then be trimmed to produce the final formed fabric treatment 10. Selvage may then be recycled for use in forming new sheets or other products.

Figure 7:
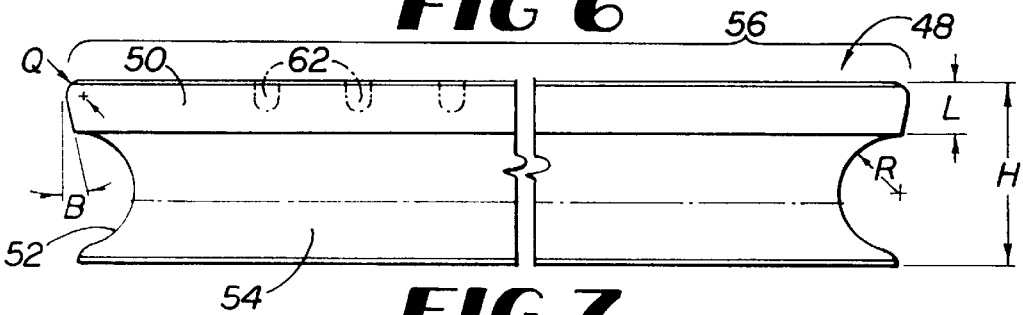
FIG. 7 is a side view of a tool for use with the bladder press of FIG. 3.

As shown in FIG. 7, tool 48 has base 54 and a top 56. Top 56 is surrounded by and joins an inwardly sloping edge 50 along a radius Q. An undercut 52, which may be formed by machining or otherwise forming a cove having radius R defines the lower extent of edge 50. Edge 50 and undercut 52 form peripheral flange 18 of fabric treatment 10. Edge 50 may slope inward at angle B. The magnitude of angle B may be selected to create a desired in-cut angle A of flange 18 (shown in FIG. 1). For instance, in the illustrative embodiment, angle B is approximately 22 degrees. Because flange 18 rebounds somewhat when removed from the tool 48, the resultant angle A of flange 18 in the illustrative embodiment is about 90 degrees. Variation of angle B and the materials used in lay-up 40 will produce variations in angle A as desired. Base 54 of tool 48 has undercut 52 about its periphery.

Figure 12:
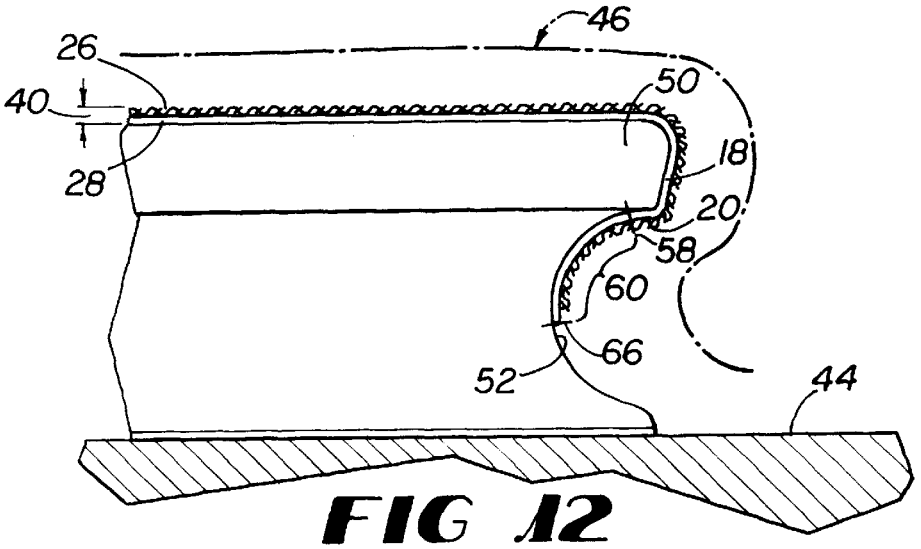
FIG. 12 is a partial cross-section of the tool of FIG. 7.

Radius R may be varied in size to produce the desired treatment 10. Radius R must be large enough to permit lay-up 40 to be completely drawn into undercut 52 at least to point 58, as shown in FIG. 12. In the illustrative example shown in FIG. 7, tool 48 has a height H of about 2.37 inches, lip height L of about 0.62 inches and radius R of about 0.75 inches.

As bladder 46 is inflated, thereby forcing lay-up 40 about edge 50 and into undercut 52, layers 26 and 28 of lay-up 40 are allowed to slide with respect to each other, thereby avoiding wrinkles that might be caused if differential movement between the layers were not allowed. Heat is then applied, which activates the adhesive between layers 26 and 28 and the activating fibers and binders in layer 28, thereby bonding the layers and fixing lay-up 40 in the desired shape. Once the assembly is removed from mold 42 and allowed to cool, selvage portion 60 is trimmed at point 58, thereby forming lip 20.

Figure 8:
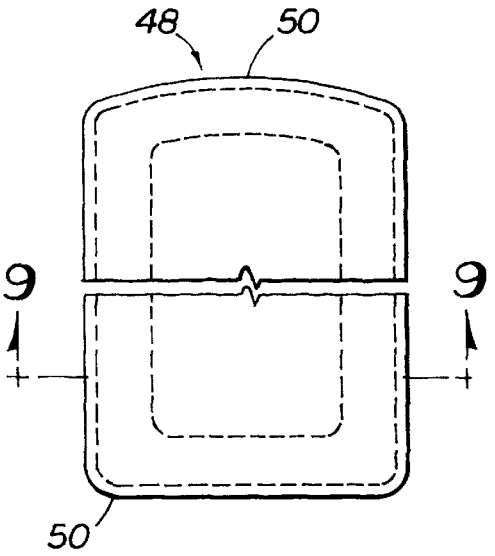
FIG. 8 is a top view of a tool for use with the bladder press of FIG. 3.
Figure 10:
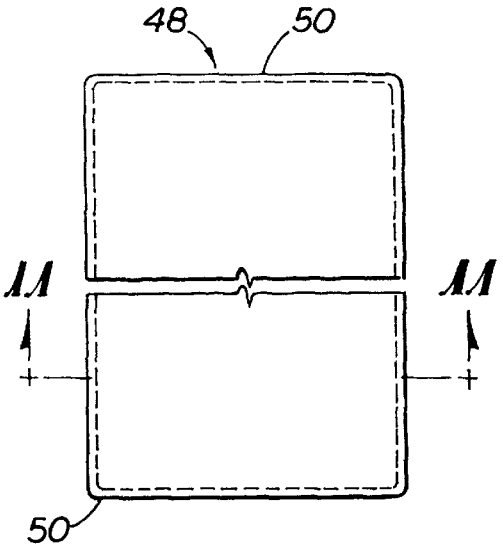
FIG. 10 is a top view of a tool for use with the bladder press of FIG. 3.
Figure 9:
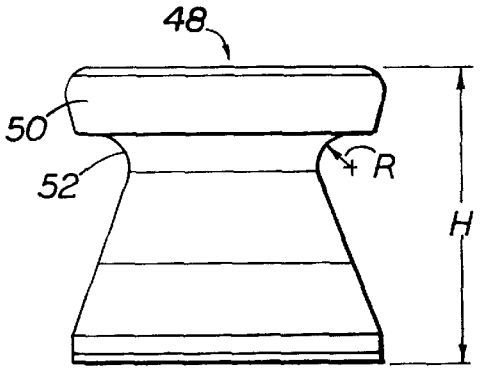
FIG. 9 is an end view of the tool of FIG. 8.
Figure 11:
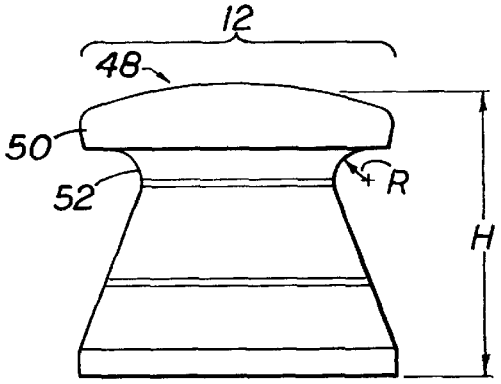
FIG. 11 is an end view of the tool of FIG. 10.
Figure 16:
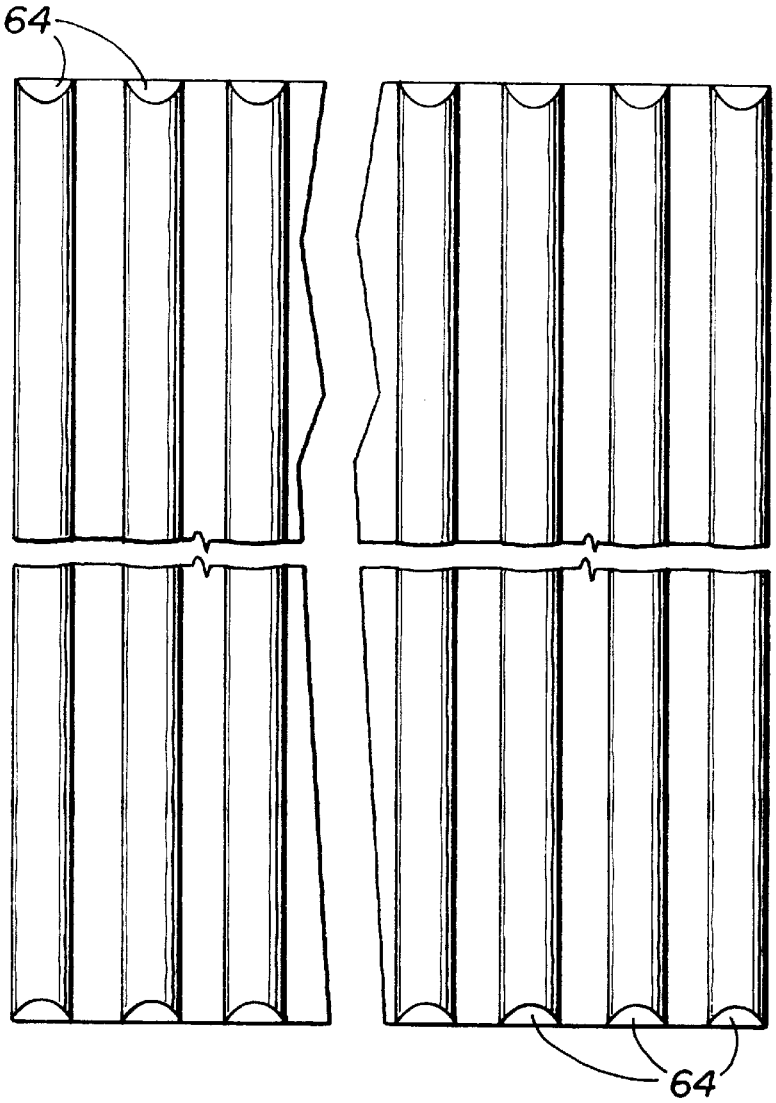
FIG. 16 is a top view of a decorative mold for use with the tool of FIG. 7.
Figure 17:
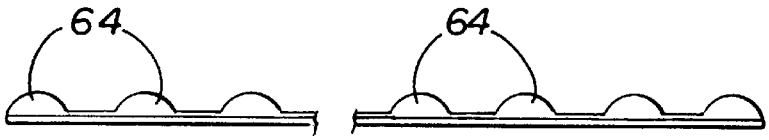
FIG. 17 is a side view of the mold of FIG. 16.
Figure 18:
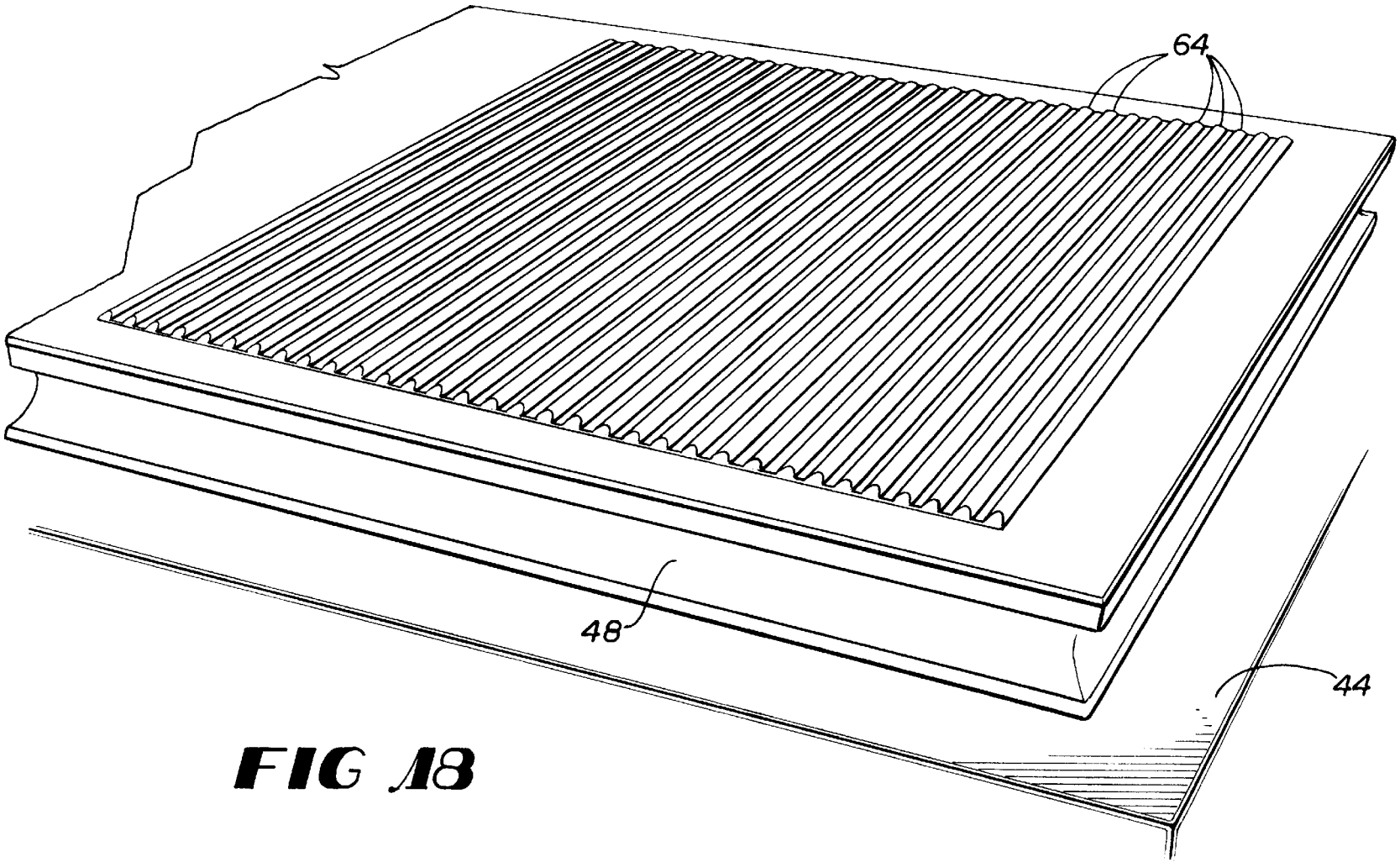
FIG. 18 is a perspective view of the mold of FIG. 16 shown in use.

FIGS. 8–11 show alternate embodiments of tools 48 that may be used to form narrower treatments 10 and treatments with central portions 12 having different characteristics. For example, FIG. 11 shows tool 48 having a crowned central portion 12 for forming a treatment 10 with a curved top. Likewise, FIG. 8 shows tool 48 having a rounded lip 50 for providing treatments 10 with a curved periphery. Other tool features, such as grooves 62 (FIG. 7) or ridges 64 (FIGS. 16–18) may be provided on central portion 12 of tool 48 to create aesthetic or structural features in central portion 12 of treatment 10. Such tool features may be provided in temporary form, e.g., fillable grooves or removable ridge templates, such that one tool may be used to produce a multitude of treatment 10 products. Note that radius R may vary substantially in size, provided sufficient height H is allowed such that lay-up 40 may be fully drawn into undercut 52.

Tools 48 may be collapsible to permit easy removal of treatment 10 once it has cooled after molding. Collapsible molding tools are well known in the arts of molding and thermoforming and conventional designs may be selected and applied as appropriate.

Figure 13:
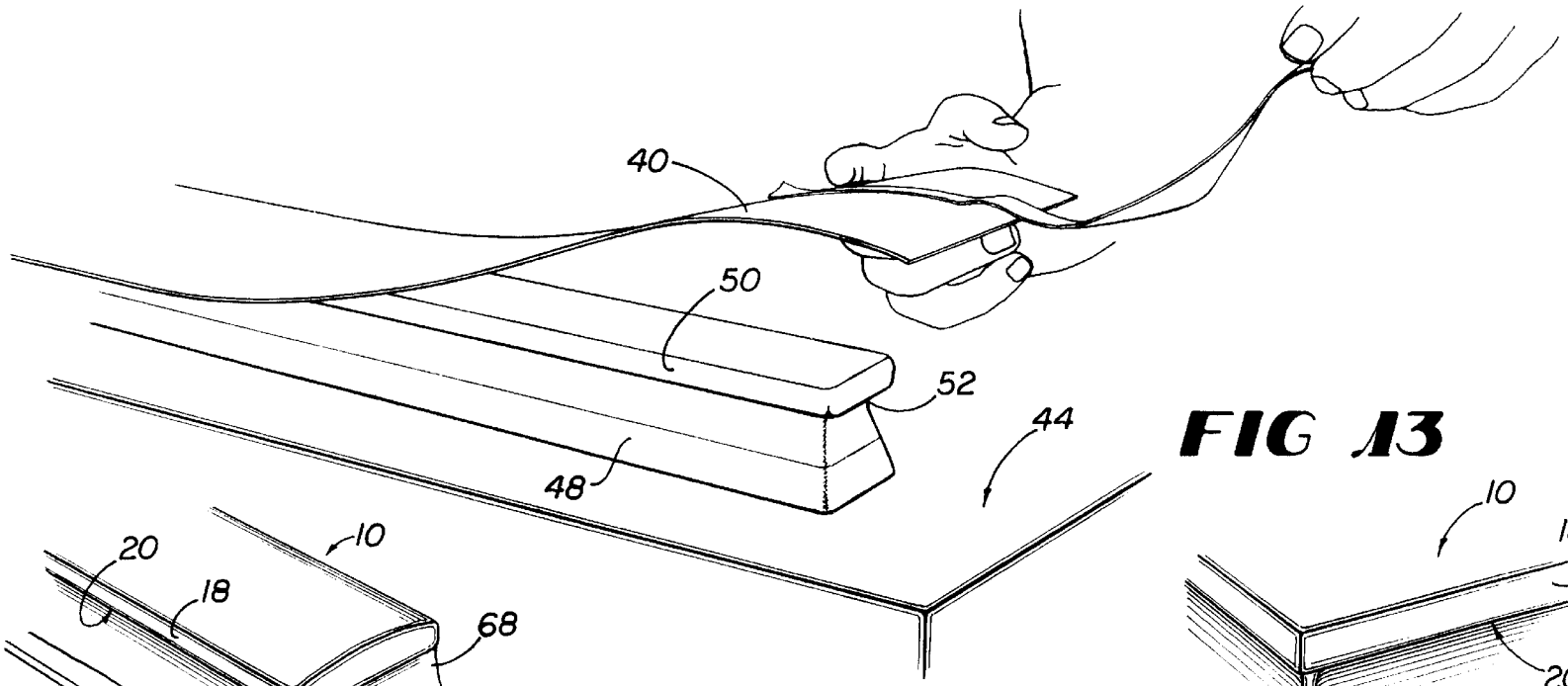
FIG. 13 is a perspective view of the tool of FIG. 12 with a lay-up partially in place for molding.
Figure 15:
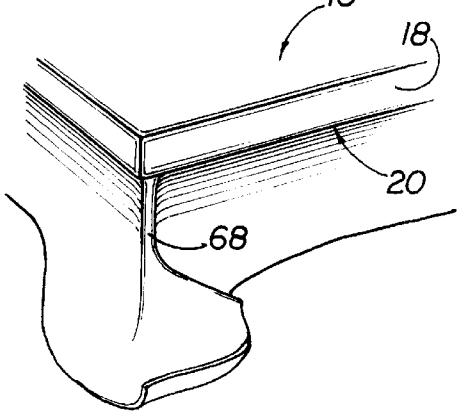
FIG. 15 is a partial perspective view of the tool of FIG. 12 showing the corner portion with the fabric treatment molded thereto.
Figure 14:
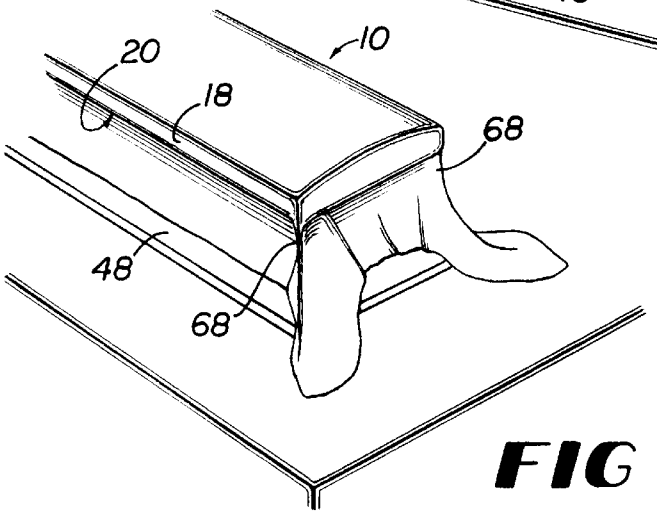
FIG. 14 is a perspective view of the tool of FIG. 12 showing the fabric treatment of the invention molded thereto.

FIGS. 13–15 show the various stages of placing lay-up 40 on tool 48 and molding it. In FIG. 13, lay-up 40 is being placed over tool 48. Note that the edges of lay-up 40 extend well beyond peripheral lip 50 of tool 48. This "overfly" permits bladder 46 (not shown, see FIGS. 3–5) to draw lay-up 40 under undercut 52 to the desired degree. The amount of overfly must be limited, however, so that lay-up 40 is not captured between bladder 46 and bed 44. Such capture would pinch the edge of lay-up 40 and hold it out from tool 48, thereby preventing lay-up 40 from being drawn into undercut 52. Thus, as shown in FIGS. 12 and 14, when lay-up 40 is fully formed about tool 48, edge 66 of lay-up 40 is not in contact with bed 44.

As can be seen in FIGS. 14–15, the molding process tends to form a prow-shaped feature 68 (the "prow") at the corners of treatment 10 (before trimming selvage). Prow 68 is formed when bladder 46 (see FIGS. 3–5) draws lay-up 40 into undercut 52. At the corners of tool 48 bladder 46 pinches lay-up 40 and, instead of drawing lay-up 40 into undercut 52, bladder 46 pulls lay-up 40 out slightly so that it forms prow 68. As noted above, a consistent problem in forming or otherwise attaching fabrics about a corner is the need to bunch or pleat fabric about the corner. This creates an unsightly effect. Because of prow 68, combined with the slippage allowed between layers of lay-up 40, fabrics formed according to the present invention form very smooth corners with little or no bunching or pleating. Thus, products to which treatment 10 are applied need not have corner caps or other "fixes" to avoid the unsightly effect caused by bunching or pleating.

Figure 19:
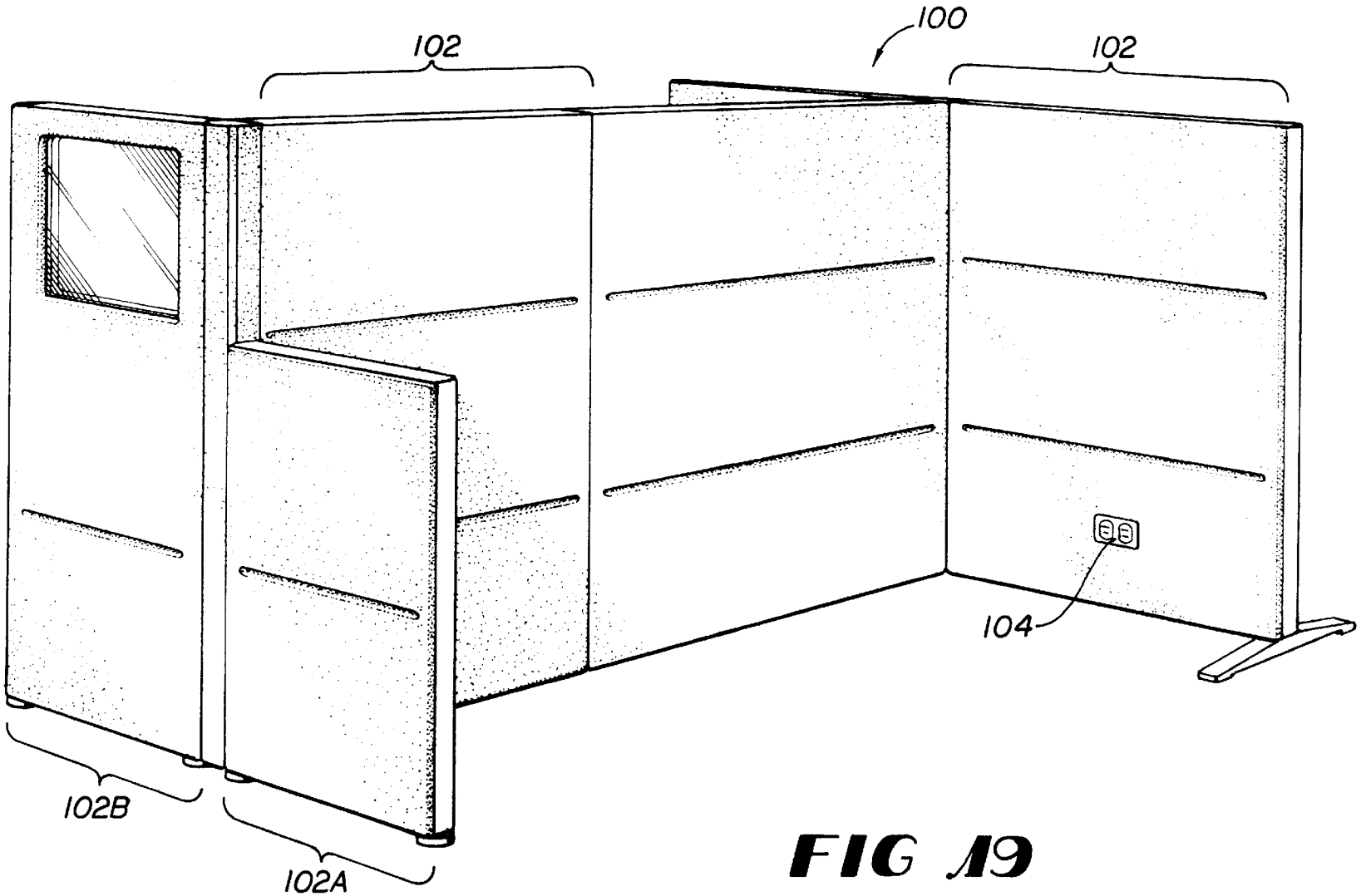
FIG. 19 is a perspective view of a modular office divider assembly in accordance with the present invention.

FIGS. 19–31 show various embodiments of treatments 10 as used in modular office dividers and wall treatments. FIG. 19 shows an office divider system 100 having sections 102. Sections 102 may be of varying sizes and joined at their edges to other sections 102 to configure office space in virtually any desirable configuration. For instance, shorter sections 102A may be provided to allow visibility into cubicle areas. Window sections 102B, which include a window pane, also may be provided for the same purpose. Power outlets 104 may be provided within sections 102 so that office equipment may be used in each cubicle formed by divider assembly 100.

Referring to FIG. 20, each section 102 comprises frame 106 and two treatments 10 in accordance with the present invention. Section 102 may use only treatment 10 if, for instance, the uncovered side is not in view. Frame 106 comprises two side rails 108, top rail 110 and bottom rail 112. Rails 108–112 may be made of wood, aluminum, steel, plastic or any other appropriate material. Rails 108–112 are joined with fasteners, glue, welding or any other means. Braces 114 may be provided to stabilize and square frame 106. Adjoining sections 102 may be connected to one another with conventional fasteners 116, such as nuts and bolts. While other, more permanent fasteners may be used, removable fasteners are preferred because installations of office divider assemblies 102 are not typically permanent structures. As shown in FIG. 21, rails 108–112 each have a lip 118 formed along each outer edge for mating with treatments 10. Treatments 10A may also be provided on the ends of sections 102 where no further sections are to be joined—such treatments 10A are referred to as endcaps. Treatments may also be provided along the tops of sections 102 (not shown).

Treatments 10 may define grooves 121 in order to stiffen and rigidify treatments 10. Alternatively (not shown), corrugations or other surface features may be formed to stiffen, rigidify and/or create aesthetic features on treatments 10.

Figure 22:
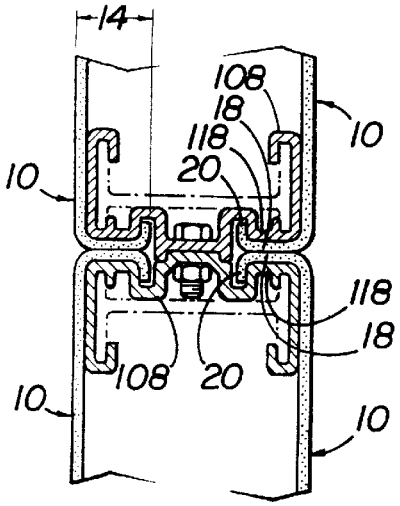
FIG. 22 is a partial cross-sectional view of the frame of FIG. 19

Referring to FIG. 22, treatment 10 is affixed to rail 108 by "snapping" affixing means 14 about lip 118. Because rails 110–112 are constructed in a fashion similar to rails 108, the following discussion will refer to rails 108. It is understood, however, that discussion of the structure and function of rails 108 applies equally to rails 110–112. Flange 18 and lip 20 are formed to cooperate with lip 118 to secure treatment 10 to rail 108. Adjoining rails 118 are held together by fasteners 116 at a sufficient separation to allow the installation of treatments 10 while being sufficiently close enough to provide a relatively narrow separation between installed treatments 10, thereby providing an aesthetically pleasing joint between section 102. This spacing may be varied to produce any desired effect. Because (as shown in FIG. 20) affixing means 14 and lip 118 are relatively continuous about the periphery of treatment 10 and frame 106, respectively, treatment 10 is firmly secured to frame 106 without the need for additional fasteners or clips. Treatment 10 is installed by snapping corner 120 of treatment 10 over corner 122 of frame 106. The installer then runs his or her hand along the edge of treatment 10, gently snapping affixing means 14 over lip 118 of rail 106.

Figure 23:
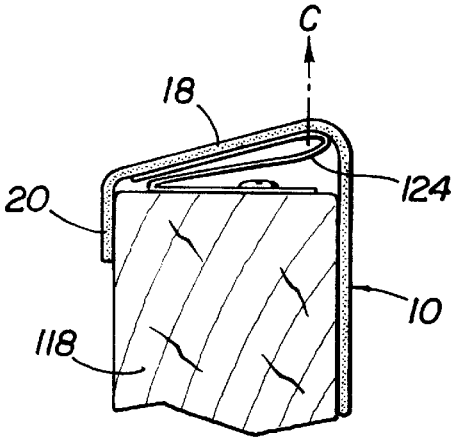
FIG. 23 is a partial cross-sectional view of an alternate embodiment of the lip of the rail of FIG. 19.

Referring to FIG. 23, rails 108 may be provided with lip spring 124 in place of lip 118. Lip spring 124 comprises a spring-like structure, made of plastic, metal or any other appropriate material, which urges flange 18 outwardly in direction C. In the illustrative embodiment, spring lip 124 is an "S"-shaped spring steel clip, although other configurations may be provided. Spring lip 124 serves to provide additional tension to hold treatment 10 taught.

Figure 24:
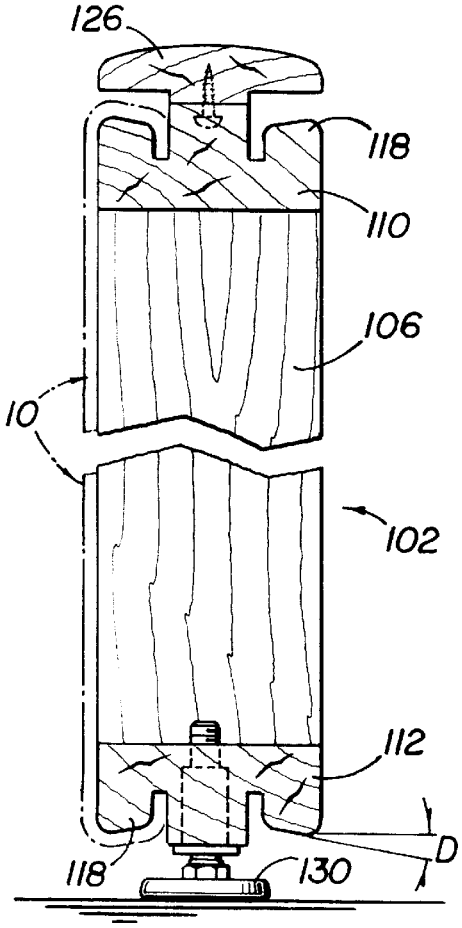
FIG. 24 is a partial cross-sectional side view of the frame of FIG. 19.
Figure 25:
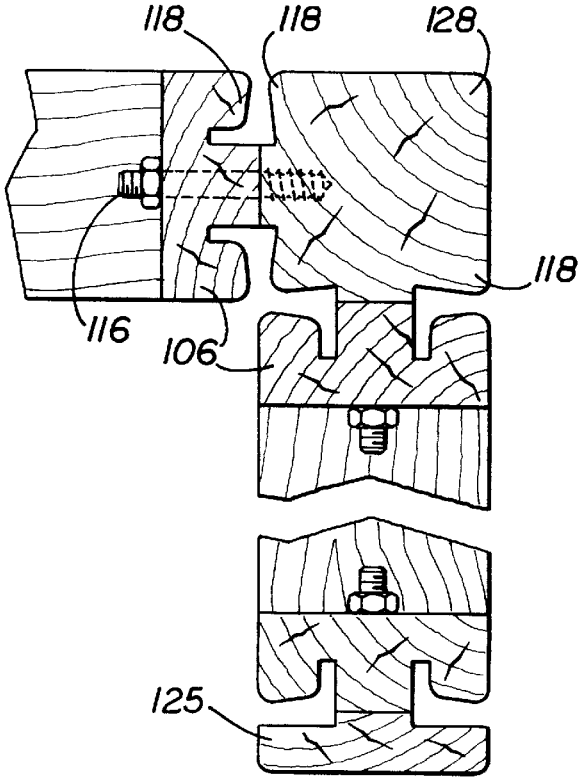
FIG. 25 is a partial cross-sectional top view of the frame of FIG. 19.

FIGS. 24 and 25 show an alternative embodiment of frames 106. Frames 106 may be provided with an end rail 125 or a top rail 126 which allow a treatment 10 to be applied along the top or side of section 102. A conventional foot-pad 130 may be affixed to rail 112. Rails 108–112 may be formed from a single, extruded plastic block having lips 118. Lips 118 may be incut slightly at angle D so that flange 18 of treatment 10 (not shown) may be less visible. As noted above, angle A of treatment 10 may be varied as desired to conform to angle D of the structure to be treated. Corner frame 128 may also be provided. Corner covers (not shown) may be applied to corner frames 128 in the same manner as described above with respect to treatments 110, i.e., affixing means 14 is snapped over lips 118 to secure corner cover (not shown) in place.

Figures 26, 27, 28:
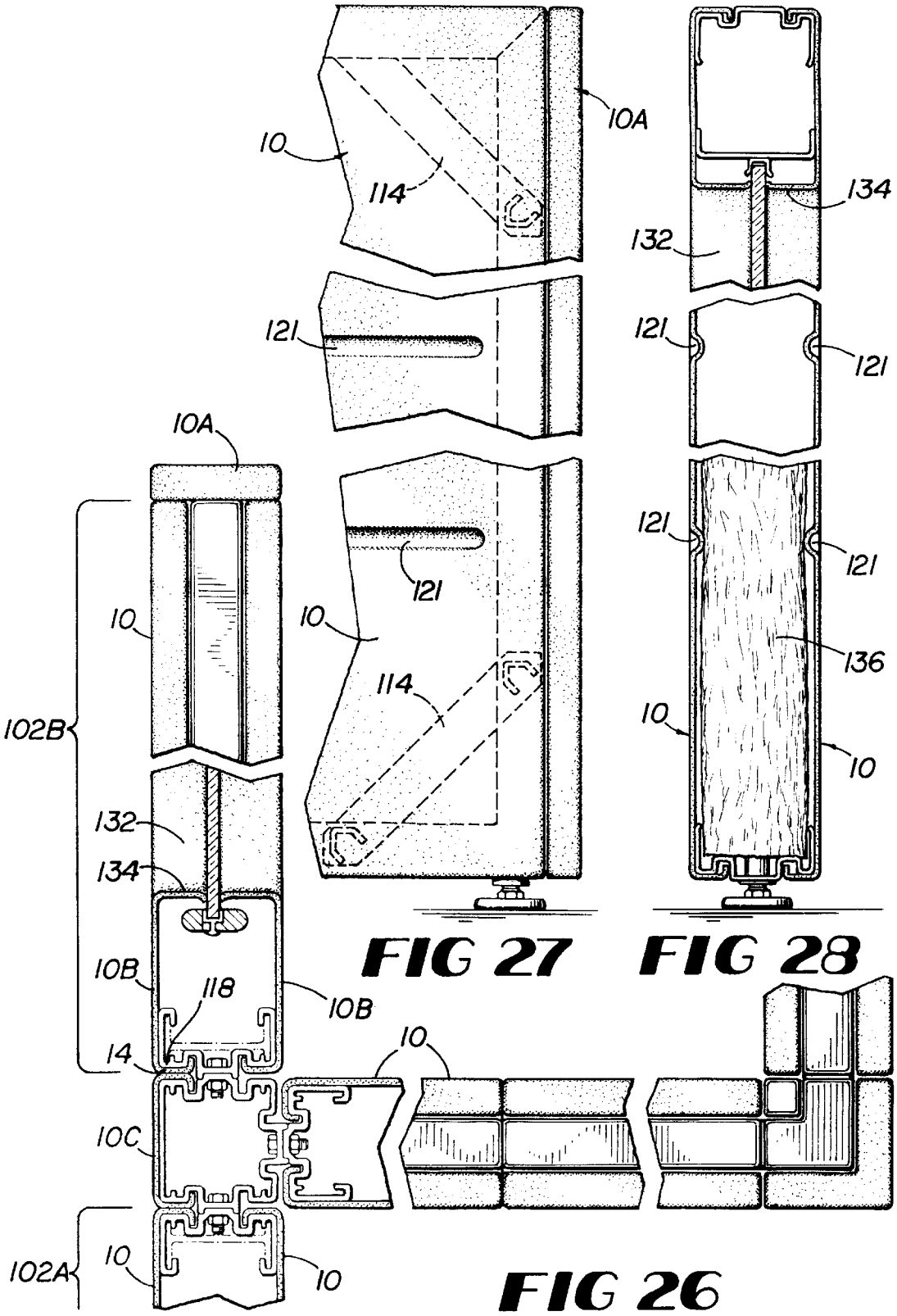
FIG. 26 is a partial cross-sectional view of the assembly of FIG. 19.
FIG. 27 is a partial side view of the assembly of FIG. 19.
FIG. 28 is a partial cross-sectional view of the assembly of FIG. 19.

As shown in FIGS. 26–28, treatments 10 may be produced in a variety of different shapes and sizes in order to accommodate different frame designs and structures. For example, a small panel may be formed to provide a decorative end-cap 10A for the terminal edge of a partition section. Also, where the partition is partially glazed (as shown in FIG. 1, in portion 12B), treatment 10B may included an interior opening 132, defined by interior flange 134. Smaller intermediate panels 10C may be necessary at junctions between sections 12.

As shown in FIG. 28, the interior space between two treatments 10 may be filled with batting 136 in order to provide certain characteristics which may be desired, such as sound attenuation or flame retardance.

Figure 29:
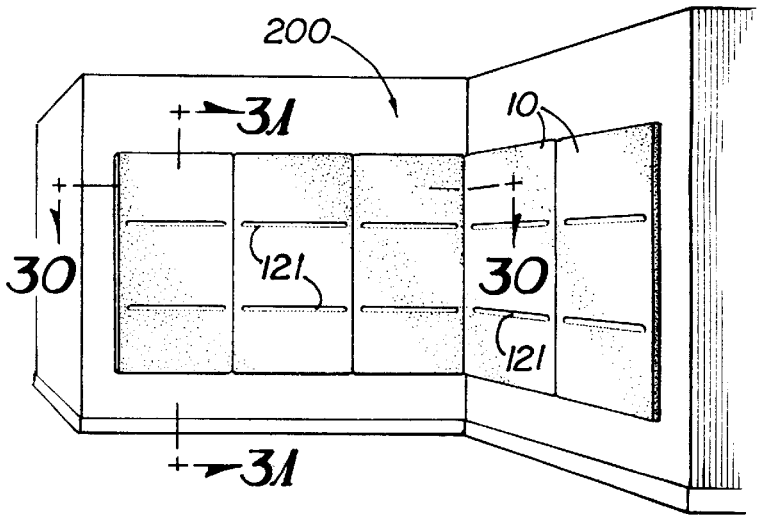
FIG. 29 is a perspective view of an alternative embodiment of a modular office divider assembly in accordance with the present invention.
Figure 30:
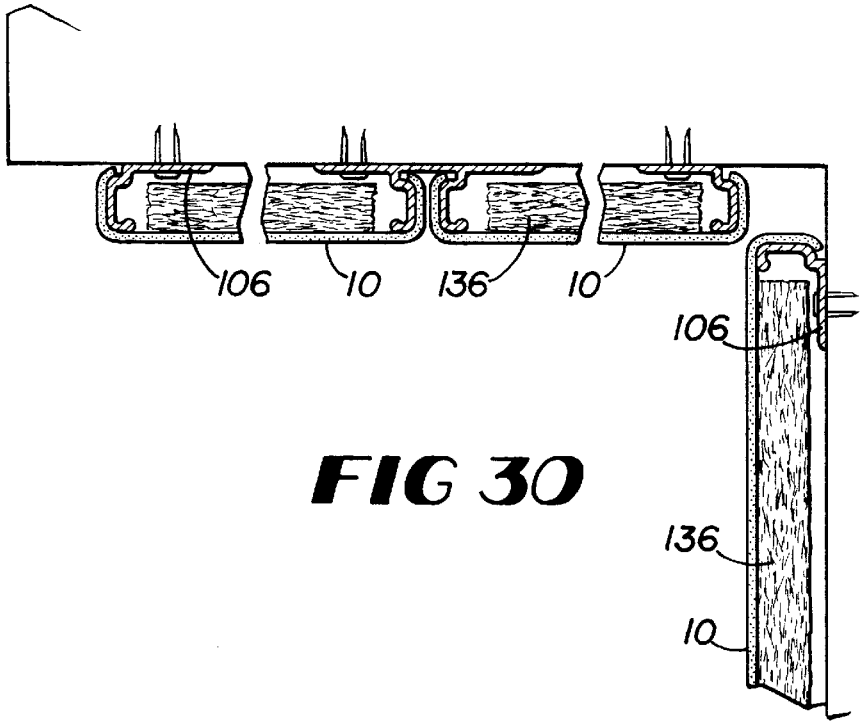
FIG. 30 is a partial cross-sectional view of the assembly of FIG. 28.
Figure 31:
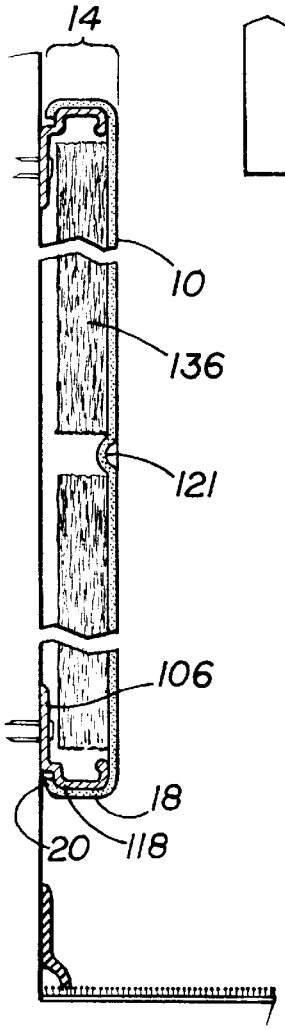
FIG. 31 is a partial cross-sectional view of the assembly of FIG. 28.

In an alternative embodiment, as shown in FIGS. 29–31, modular decorative wall treatments 200 may be provided which comprise frames 106 and treatments 10. Frames 106 are affixed directly to an existing wall and have lips 118 as described above. Treatments 1, having affixing means 14, are affixed thereto in the same manner as that described above, i.e., flanges 18 and lips 20 are "snapped" over lips 118. Batting 136 may be inserted in the space between treatment 10 and the wall in order to provide sound attenuation or fire retardance. In fact, treatments 10 may be provided to camouflage acoustic panels, speakers or other devices which might be necessary in particular rooms, such as studios, galleries or theaters.

Although the foregoing is provided for purposes of illustrating, explaining and describing certain embodiments of the modular divider screen in particular detail, modifications and adaptations to the described screens and other embodiments will be apparent to those skilled in the art and may be made without departing from the scope or spirit of the invention.

What is claimed is:

1. A method for making a molded fabric treatment, comprising:

a) providing a non-woven fabric backing sheet which comprises, at least in part, heat-fusible fibers and a heat-activated binder;

b) providing a fabric facing sheet and a heat- or pressure-activated adhesive layer;

c) placing together and aligning the facing sheet and the backing sheet with the adhesive layer therebetween to form a lay-up having a periphery;

d) bladder molding the lay-up against a tool to form the treatment such that the periphery of the lay-up is forced into a peripheral undercut in the tool to form the lay-up into a treatment having a central portion with a substantially continuous undercut affixing portion about the periphery of the treatment; and e) removing the treatment from the tool.

2. The method of claim 1, in which the tool has a plurality of corners and wherein bladder molding the lay-up further comprises forming the lay-up into a prow-shaped structure at all of the corners of the tool such that corresponding corners of the treatment are smooth.

3. The method of claim 1, wherein providing the backing sheet further comprises providing a non-woven fabric backing sheet moldable into a desired shape by the application of heat or pressure.

4. The method of claim 1, wherein providing the backing sheet further comprises providing the backing sheet only at the undercut affixing portion of the treatment.

5. The method of claim 1, wherein bladder molding the lay-up further comprises applying heat to the backing sheet so that it remains in its molded shape.

6. The method of claim 1, wherein bladder molding the lay-up further comprises the undercut affixing portion forming a flexible flange and an inwardly-turned lip.

7. The method of claim 1, wherein bladder molding the lay-up further comprises the undercut affixing portion forming an inwardly-angled flexible flange and an inwardly-turned lip, the lip formed parallel to the central portion of the treatment.

8. The method of claim 1, wherein bladder molding the lay-up further comprises forcing the lay-up into the peripheral undercut having a radius large enough such that the periphery of the lay-up is completely drawn into the peripheral undercut.

9. The method of claim 1, wherein bladder molding the lay-up further comprises applying about 5.5 bars of pressure at about 180 degrees Celsius for about 120 seconds to about 160 seconds.

10. The method of claim 1, wherein the fabric backing sheet, the adhesive layer and the fabric facing sheet are made of materials capable of being recycled together.

11. The method of claim 1, wherein the backing sheet comprises non-hygroscopic fibers.

12. The method of claim 1, wherein the backing sheet comprises hygroscopic fibers.

13. The method of claim 1, further comprising forming the lay-up or treatment with at least one additional material layer selected from the group consisting of a fire retardant sheet, a sound attenuating sheet, and a backing board, each additional material layer being either interposed between the facing sheet and the backing sheet in the lay-up or affixed to the inside of the lay-up or treatment.

14. The method of claim 1, in which bladder molding the lay-up further comprises forming grooves in the central portion.

15. The method of claim 1, in which bladder molding the lay-up further comprises forming ridges in the central portion.

16. A method for making a molded fabric treatment, comprising:

a) providing a non-woven backing sheet which comprises, at least in part, heat-fusible fibers and a heat-activated binder;

b) providing a fabric facing sheet;

c) providing a heat- or pressure-activated adhesive layer;

d) placing together and aligning the facing sheet and the backing sheet with the adhesive layer therebetween to form a lay-up having a periphery, wherein the adhesive layer allows slippage between the facing sheet and backing sheet of the lay-up;

e) bladder molding the lay-up against a tool to form the treatment such that the periphery of the lay-up is forced into a peripheral undercut in the tool to form the lay-up into a treatment having a central portion with a substantially continuous undercut affixing portion about the periphery of the treatment; and f) removing the treatment from the tool.

17. The method of claim 16, wherein the tool has a plurality of corners and wherein bladder molding the lay-up further comprises forming the lay-up into a prow-shaped structure at all of the corners of the tool such that corresponding corners of the treatment are smooth.

18. The method of claim 16, wherein bladder molding the lay-up further comprises applying heat to the backing sheet so that it remains in its molded shape.

19. The method of claim 16, wherein bladder molding the lay-up further comprises bonding together the backing sheet and the facing sheet.

20. The method of claim 16, wherein bladder molding the lay-up further comprises the undercut affixing portion forming a flexible flange and an inwardly-turned lip.

21. The method of claim 16, wherein bladder molding the lay-up further comprises the undercut affixing portion forming an inwardly-angled flexible flange and an inwardly-turned lip, the lip formed parallel to the central portion of the treatment.

22. The method of claim 16, wherein bladder molding the lay-up further comprises forcing the lay-up into the peripheral undercut having a radius large enough such that the periphery of the lay-up is completely drawn into the peripheral undercut.

23. The method of claim 16, wherein bladder molding the lay-up further comprises applying about 5.5 bars of pressure at about 180 degrees Celsius for about 120 seconds to about 160 seconds.

24. The method of claim 16, wherein the fabric backing sheet, the adhesive layer and the fabric facing sheet are made of materials capable of being recycled together.

25. The method of claim 16, wherein the backing sheet comprises non-hygroscopic fibers.

26. The method of claim 16, wherein the backing sheet comprises hygroscopic fibers.

27. The method of claim 16, further comprising forming the lay-up or treatment with at least one additional material layer selected from the group consisting of a fire retardant sheet, a sound attenuating sheet, and a backing board, each additional material layer being either interposed between the facing sheet and the backing sheet in the lay-up or affixed to the inside of the lay-up or treatment.

28. The method of claim 16, in which bladder molding the lay-up further comprises forming grooves in the central portion.

29. The method of claim 16, in which bladder molding the lay-up further comprises forming ridges in the central portion.

30. A method for making a molded fabric treatment, comprising:

a) providing a non-woven fabric backing sheet which comprises, at least in part, heat-fusible fibers and a heat-activated binder;

b) providing a fabric facing sheet and a heat- or pressure-activated adhesive layer;

c) placing together and aligning the facing sheet and the backing sheet with the adhesive layer therebetween to form a lay-up having a periphery;

d) providing slippage between the facing sheet and backing sheet of the lay-up;

e) bladder molding the lay-up against a tool to form the treatment such that the periphery of the lay-up is forced into a peripheral undercut in the tool to form the lay-up into a treatment having a central portion with a substantially continuous undercut affixing portion about the periphery of the treatment, such that bladder molding the lay-up bonds together the backing sheet and the facing sheet, and such that the undercut affixing portion comprises an inwardly-angled flexible flange and an inwardly-turned lip; and f) removing the treatment form the tool.

31. The method of claim 30, wherein the tool has a plurality of corners and wherein bladder molding the lay-up further comprises forming the lay-up into a prow-shaped structure at all of the corners of the tool such that corresponding corners of the treatment are smooth.

32. The method of claim 30, wherein bladder molding the lay-up further comprises applying heat to the backing sheet so that it remains in its molded shape.

33. The method of claim 30, wherein bladder molding the lay-up further comprises the undercut affixing portion inwardly-tuned lip being parallel to the central portion of the treatment.

34. The method of claim 30, wherein bladder molding the lay-up further comprises forcing the lay-up into the peripheral undercut having a radius large enough such that the periphery of the lay-up is completely drawn into the peripheral undercut.

35. The method of claim 30, wherein bladder molding the lay-up further comprises applying about 5.5 bars of pressure at about 180 degrees Celsius for about 120 seconds to about 160 seconds.

36. The method of claim 30, wherein the fabric backing sheet, the adhesive layer and the fabric facing sheet are made of materials capable of being recycled together.

37. The method of claim 30, wherein the backing sheet comprises non-hygroscopic fibers.

38. The method of claim 30, wherein the backing sheet comprises hygroscopic fibers.

39. The method of claim 30, further comprising forming the lay-up or treatment with at least one additional material layer selected from the group consisting of a fire retardant sheet, a sound attenuating sheet, and a backing board, each additional material layer being either interposed between the facing sheet and the backing sheet in the lay-up or affixed to the inside of the lay-up or treatment.

40. The method of claim 30, in which bladder molding the lay-up further comprises forming grooves in the central portion.

41. The method of claim 30, in which bladder molding the lay-up further comprises forming ridges in the central portion.

* * * * *